US006655440B2

(12) United States Patent
Brunk

(10) Patent No.: US 6,655,440 B2
(45) Date of Patent: Dec. 2, 2003

(54) GARAGE DOOR BOTTOM SEAL RETAINER

(75) Inventor: Darrin Brunk, Lawrence, KS (US)

(73) Assignee: Amarr Garage Doors, Lawrence, KS (US)

( * ) Notice: Subject to any disclaimer, the term of this patent is extended or adjusted under 35 U.S.C. 154(b) by 0 days.

(21) Appl. No.: 10/017,365

(22) Filed: Dec. 13, 2001

(65) Prior Publication Data

US 2003/0111187 A1 Jun. 19, 2003

(51) Int. Cl.[7] ..... E06B 7/16

(52) U.S. Cl. ..... 160/40; 160/229.1; 160/231.1; 160/231.2

(58) Field of Search ..... 160/133, 40, 199, 160/201, 206, 229.1, 231.1, 231.2, 232; 52/309.11, 403, 804; 49/DIG. 1, 478, 499.1

(56) References Cited

U.S. PATENT DOCUMENTS 3,161,229 A * 12/1964 Sanders ..... 160/40
3,333,385 A 8/1967 D.L. King
3,755,968 A * 9/1973 Williams ..... 49/488
4,441,301 A * 4/1984 Benson ..... 52/804
5,816,309 A * 10/1998 Paradise ..... 160/206
6,484,447 B1 * 11/2002 Snyder et al. ..... 49/499.1

FOREIGN PATENT DOCUMENTS

GB 2287747 * 9/1995 ..... 160/40 X

* cited by examiner

*Primary Examiner*—Bruce A. Lev
(74) *Attorney, Agent, or Firm*—Hovey Williams LLP

(57) ABSTRACT

A garage door bottom seal retainer (10) comprises a seal cavity (36), a exterior tension member (38), and an interior tension member (40). In use, an installer slides a retaining member (20) of a seal (12) into the seal cavity (36). Then the installer seats an exterior gripping edge (58) of the exterior tension member (38) upon an exterior shelf (32) of a bottom surface (14) of a garage door (16). The installer then applies force to the interior tension member (40) so as to seat an interior gripping edge (66) into place upon an interior shelf (34) of the bottom surface (14). In this manner, the seal (12) is secured to the retainer (10) and the retainer (10) is then secured to the garage door (16) without the use of any tools or fasteners.

15 Claims, 3 Drawing Sheets

GARAGE DOOR BOTTOM SEAL RETAINER

BACKGROUND OF THE INVENTION

1. Field of the Invention

The present invention relates to garage doors and garage door bottom seals. More particularly, the present invention relates to a garage door bottom seal retainer that can be installed onto a bottom surface of a garage door without the use of any tools or fasteners.

2. Description of the Prior Art

Garages are commonly used not only to store automobiles and other items, but also as transition zones between the insides and outsides of houses. Therefore, garages need some degree of protection from weather and other elements. A commonly used component used to provide this protection is a seal secured to a bottom surface of a garage door. The seal helps the garage door keep out noise, rain, wind, and other elements.

Currently, there are three types of retainers commonly available to attach a seal to a bottom surface of a garage door. A first type is an aluminum extrusion that is screwed onto the bottom surface with metal screws. One concern with these types of retainers is that the metal screws extend upward through a lower section of the door and are exposed and thus present a risk of injury to persons gripping the bottom surface of the door during opening and closing.

Another concern is electrolysis corrosion caused because the metal screws are typically formed of a dissimilar metal as compared with the aluminum extrusion. Screw-type fasteners are also labor intensive to install and destroy the integrity of pre-painted steel door panels, exposing the panel material to oxidation and producing loose shavings.

A second type of seal retainer is a plastic extrusion that is screwed onto a bottom surface of a garage door with metal screws. This type also suffers from the exposed screw problem described above.

A third type of seal retainer is an aluminum extrusion that is crimped into a bottom surface of a garage door. While this type does have some advantages, it requires a special purpose-built crimping tool.

All three types of retainers discussed above complicate installing a garage door by requiring tools, such as, a screwdriver or a crimping tool, to secure a seal to a bottom surface of the garage door. Additionally, some retainers require fasteners, which have additional concerns as discussed above.

Accordingly, there is a need for an improved garage door bottom seal retainer that overcomes the limitations of the prior art.

SUMMARY OF THE INVENTION

The garage door bottom seal retainer of the present invention overcomes the above-identified problems and provides a distinct advance in the art. More particularly the present invention provides a garage door bottom seal retainer that can be used to secure a seal onto a bottom surface of a garage door without the use of any tools or fasteners and that does not present exposed screws that may cause injury.

The retainer is preferably used with a seal comprising a cylindrical cushion and a retaining member with an exterior shoulder and an interior shoulder. The retainer preferably retains the seal on a garage door having a bottom surface that comprises an exterior lip with an exterior shelf and an interior lip with an interior shelf.

The preferred garage door bottom seal retainer broadly comprises a seal cavity, a exterior tension member, and an interior tension member. The seal cavity runs substantially the entire length of the retainer, which runs substantially the entire length of the bottom surface of the garage door. The seal cavity includes a seal opening, through which the retaining member of the seal is inserted, in order to mate the seal with the retainer.

The exterior tension member also runs substantially the entire length of the retainer. The exterior tension member includes an exterior gripping edge, which is supported by the exterior lip of the bottom surface of the garage door.

The interior tension member also runs substantially the entire length of the retainer. The interior tension member includes an interior gripping edge, which is supported by the interior lip of the bottom surface of the garage door.

In use, an installer slides the retaining member of the seal into the seal cavity of the retainer along its entire length. Then the installer seats the exterior gripping edge of the exterior tension member upon the exterior shelf of the exterior lip along it entire length. The installer then applies force to the interior tension member so as to seat the interior gripping edge into place upon the interior shelf of the interior lip.

In this manner, the seal is secured to the retainer and the retainer is then secured to the garage door. It can be seen that this is done without the use of any tools or fasteners and overcomes the limitations of the prior art.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 2:
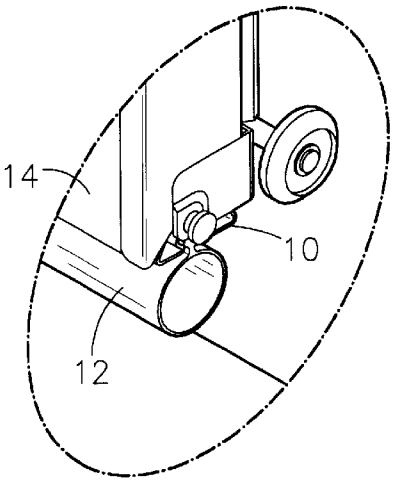
FIG. 2 is an enlarged view of a portion of FIG. 1.
Figure 1:
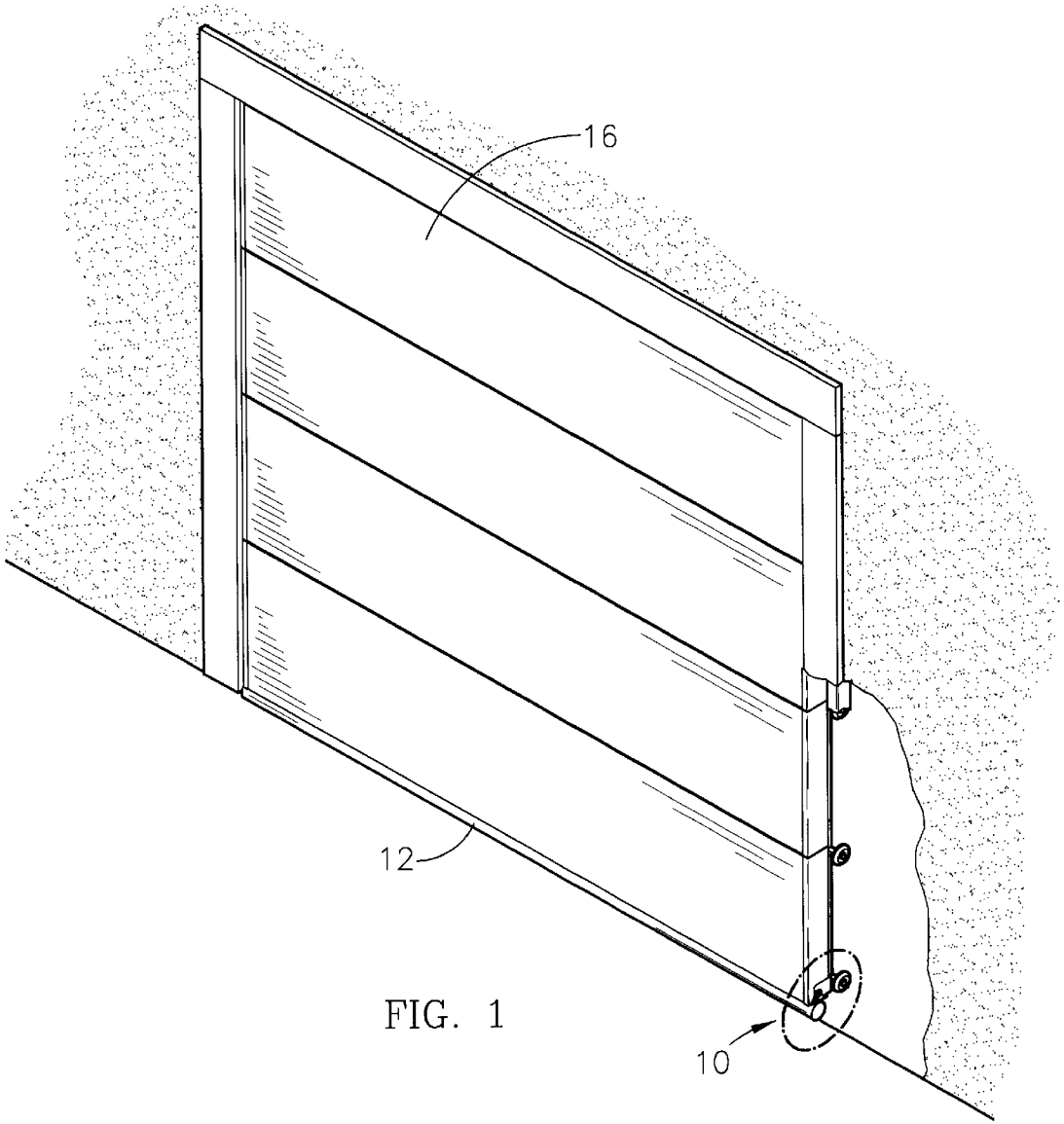
FIG. 1 is a perspective view of a garage door bottom seal retainer and a seal constructed in accordance with a preferred embodiment of the present invention and shown attached to a conventional garage door.

Referring to FIG. 1 and FIG. 2, a garage door bottom seal retainer 10 is shown constructed in accordance with a preferred embodiment of the present invention. The retainer 10 is used to secure a seal 12 to a bottom surface 14 of a garage door 16 without the use of any tools or fasteners.

Figure 3:
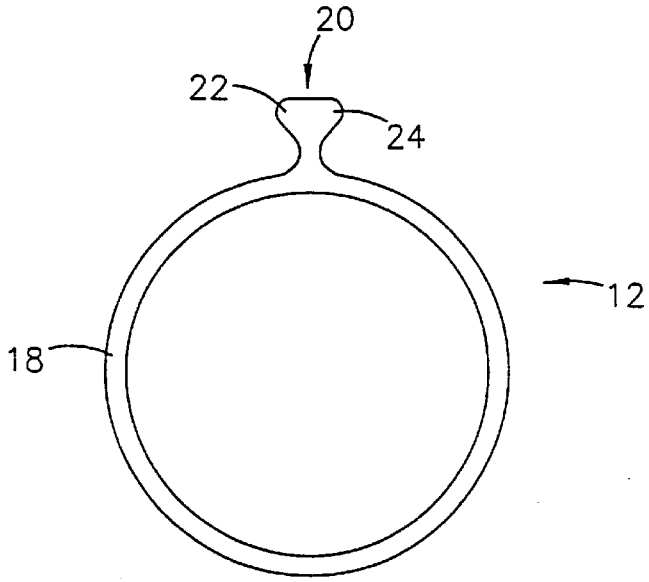
FIG. 3 is a side elevational view of the seal.

Also referring to FIG. 3, the seal 12 is preferably constructed of plastic and is approximately eight feet long. The seal 12 preferably comprises an approximately two inch diameter cylindrical cushion 18 and a retaining member 20. The cushion 18 is pliable and operable to conform to a floor when compressed, substantially sealing the garage door 16 to the floor. The retaining member 20 comprises an exterior shoulder 22 and an interior shoulder 24. The seal 12 is preferably mated to the retainer 10, during installation, when the retainer 10 is not affixed to the door 16.

However, while the cushion 18 is preferably cylindrical, it may be any shape allowing it to substantially seal the garage door 16 to the floor. Additionally, while the seal 12 is preferably mated to the retainer 10 before the retainer 10 is affixed to the door 16, the seal 12 may also be mated to the retainer 10 after the retainer 10 has been affixed to the door 16.

Figure 4:
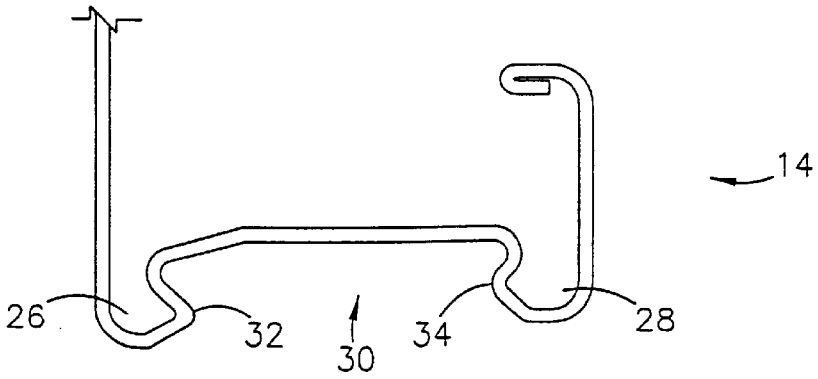
FIG. 4 is a side elevational view of the bottom surface of the garage door.

Also referring to FIG. 4, the bottom surface 14 of the garage door 16 is approximately eight feet long and comprises an exterior lip 26, an interior lip 28, and a retainer cavity 30 therebetween. The exterior lip 26 protrudes from the bottom surface 14 downward and includes an exterior shelf 32 extending into the retainer cavity 30. The interior lip 28 also protrudes from the bottom surface 14 downward and includes an interior shelf 34 extending into the retainer cavity 30.

Figure 5:
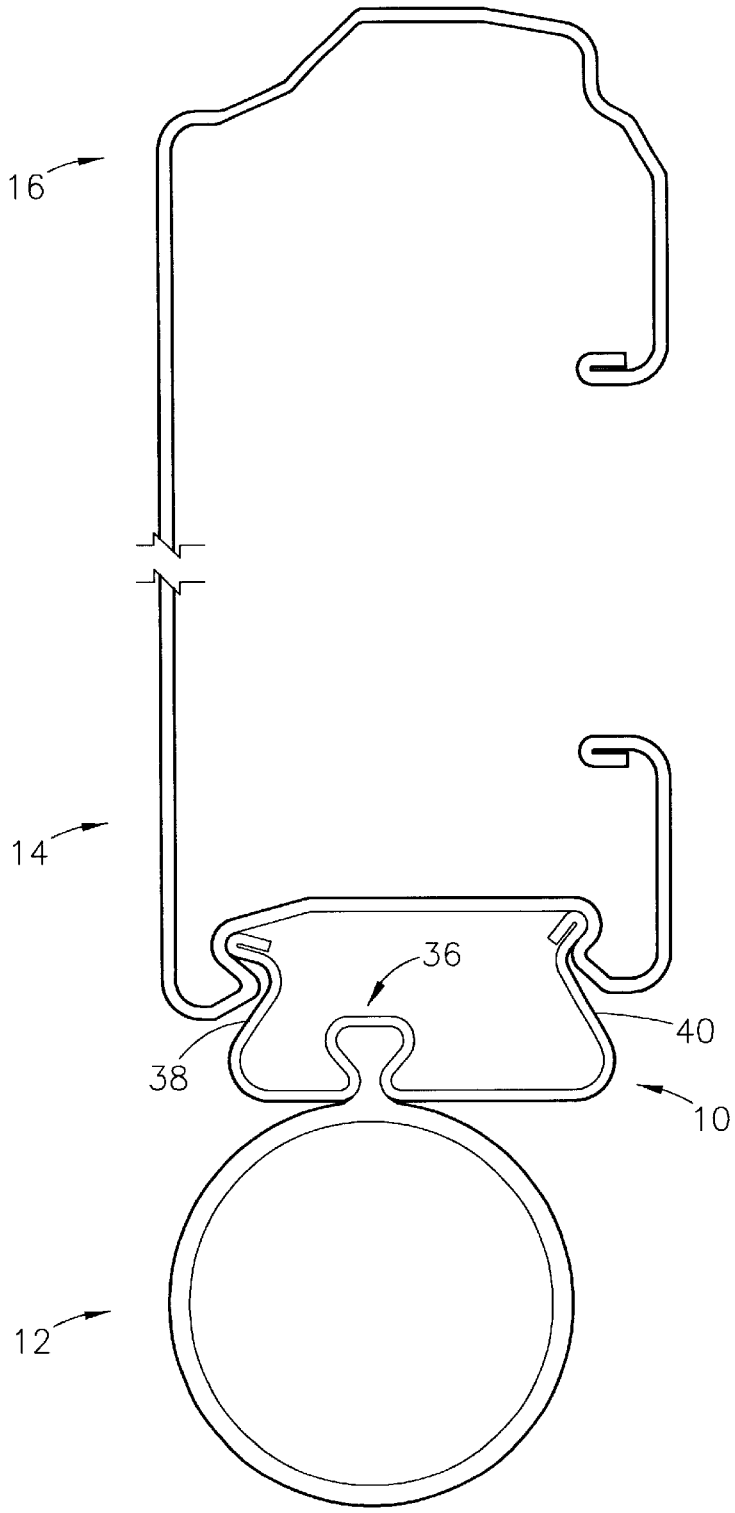
FIG. 5 is a side elevational view of the garage door bottom seal retainer and the seal shown attached to a bottom surface of the garage door.

Also referring to FIG. 5, the retainer 10 broadly comprises a seal cavity 36, a exterior tension member 38, and an interior tension member 40. The retainer 10 is preferably constructed of steel which is approximately one thirty-second of an inch thick and approximately eight feet long.

Figure 6:
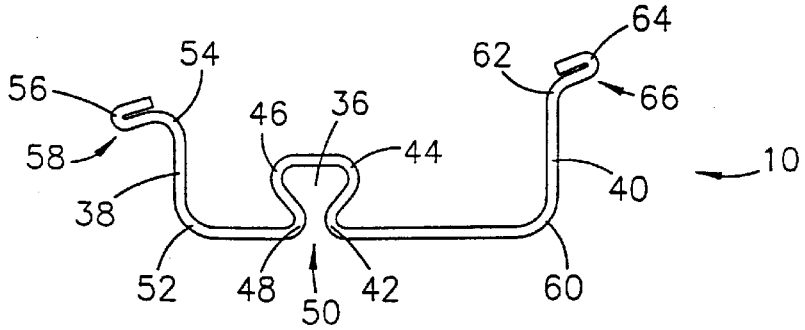
FIG. 6 is a side elevational view of the garage door bottom seal retainer, shown before it is attached to either the seal or the bottom surface of the garage door.

The seal cavity 36 runs substantially the entire length of the retainer 10. Also referring to FIG. 6, the seal cavity 36 is formed by first finding a center line approximately two and one half inches from each edge of the retainer 10. The retainer 10 is bent at the center line forming a first cavity bend 42 of approximately one hundred and twenty degrees along the length of the retainer 10. The retainer 10 is then bent forming a second cavity bend 44 of approximately one hundred and twenty degrees along the length of the retainer 10. The second cavity bend 44 occurs approximately one quarter inch from the first cavity bend 42. The second cavity bend 44 is bent in the opposite direction of the first cavity bend 42.

The retainer 10 is then bent forming a third cavity bend 46 of approximately one hundred and twenty degrees along the length of the retainer 10. The third cavity bend 46 occurs approximately one half inch from the second cavity bend 44. The third cavity bend 46 is bent in the same direction as the second cavity bend 44.

Finally, the retainer 10 is bent forming a forth cavity bend 48 of approximately one hundred and twenty degrees along the length of the retainer 10. The forth cavity bend 48 occurs approximately one quarter inch from the third cavity bend 46. The forth cavity bend 48 is bent in the opposite direction of the third cavity bend 46.

This process results in the seal cavity 36 being formed in the retainer 10 offset toward the exterior tension member 38. As can be seen, the seal cavity 36 includes a seal opening 50 which is approximately one eighth of an inch wide.

The exterior tension member 38 is formed by first bending the retainer 10 forming a first exterior bend 52 of approximately ninety degrees along the length of the retainer 10. The first exterior bend 52 occurs to approximately one half inch from the forth cavity bend 48. The first exterior bend 52 is bent in the same direction as the forth cavity bend 48.

The retainer 10 is then bent forming a second exterior bend 54 of approximately ninety degrees along the length of the retainer 10. The second exterior bend 54 occurs approximately one half inch from the first exterior bend 52. The second exterior bend 54 is in the opposite direction of the first exterior bend 52.

Finally, the retainer 10 is bent forming a third exterior bend 56 of approximately one hundred and eighty degrees along the length of the retainer 10. The third exterior bend 56 occurs approximately one quarter inch from the second exterior bend 54. The third exterior bend 56 is in the opposite direction of the second exterior bend 54. Furthermore, the third exterior bend 56 provides rigidity to the exterior tension member 38 by forming an exterior gripping edge 58.

The interior tension member 40 is formed by first bending the retainer 10 forming a first interior bend 60 of approximately ninety degrees along the length of the retainer 10. The first interior bend 60 occurs approximately one inch from the-first cavity bend 42. The first interior bend 60 is bent in the same direction as the first cavity bend 42.

The retainer 10 is then bent forming a second interior bend 62 of approximately ninety degrees along the length of the retainer 10. The second interior bend 62 occurs approximately one half inch from the first interior bend 60. The second interior bend 62 is in the opposite direction of the first interior bend 60.

Finally, the retainer 10 is bent forming a third interior bend 64 of approximately one hundred and eighty degrees along the length of the retainer 10. The third interior bend 64 occurs approximately one quarter inch from the second interior bend 62. The third interior bend 64 is in the opposite direction of the second interior bend 62. Furthermore, the third interior bend 64 provides rigidity to the interior tension member 40 by forming an interior gripping edge 66.

In use, an installer slides the retaining member 20 of the seal 12 into the seal cavity 36 of the retainer 10 along its entire length. The shoulders 22,24 of the retaining member 20 resist being pulled through the seal opening 50. Then the installer seats the exterior gripping edge 58 of the exterior tension member 38 upon the exterior self 32 of the exterior lip 26 along it entire length. The installer then applies force to the interior tension member 40 so as to seat the interior gripping edge 66 into place upon the interior shelf 34 of the interior lip 28.

In this manner the seal 12 is secured to the retainer 10 and the retainer 10 is then secured to the garage door 16. It can be seen that this is done without the use of any tools or fasteners and overcomes the limitations of the prior art.

While the preferred embodiment of the present invention has been described above, it is understood that other materials and/or dimensions can be substituted. These and other minor modifications are within the scope of the present invention.

For example, as described, the retainer 10, the seal 12, and the bottom surface 14 are approximately eight foot long. The eight foot length is designed to accommodate a standard eight foot wide single car garage door. While not as common, some garage doors are as narrow as five foot wide, necessitating a five foot length. Similarly, a standard sixteen foot wide double car garage door would necessitate a sixteen foot length. An unusually wide garage door could be as wide as twenty foot, necessitating a twenty foot length.

Additionally, while in the preferred embodiment, the retainer 10 is seated within the bottom surface 14, it is within the scope of the present invention to attach the retainer 10 to an exterior surface of the garage door 16. This alternative embodiment could be accomplished in a number of ways. First, the retainer could be configured as described above except the first exterior bend 52 and the first interior bend 60. These bends 52,60 would be approximately one hundred and twenty degrees. This would allow the tension members 38,40 to apply tension inwardly instead of outwardly as described above.

Second, the second exterior bend 54 and the second interior bend 62 could be bent in the opposite direction as that described above. In this embodiment, the gripping edges 58,66 would be oriented inwardly instead of outwardly as described above.

These alternative embodiments may require that the bottom surface 14 be configured differently in order to accommodate them. For instance, the shelves 32,34 may be oriented outwardly instead of inwardly as described above.

Finally, the retainer 10 may be constructed of a different material, such as, for example, plastic, aluminum, tin, copper, brass, or stainless steel. The retainer 10 may also be constructed of a different thickness, as may be required by the different material. Furthermore, the width of the retainer 10 may be modified, as a matter of design, to accommodate a wide variety of garage doors.

Having thus described a preferred embodiment of the invention, what is claimed as new and desired to be protected by letters patent includes the following:

1. A garage door bottom seal retainer for securing a seal to a bottom surface of a garage door, the retainer comprising:

an exterior tension member having an exterior bend adapted to allow the exterior tension member to mate with and to apply tension to the bottom surface of the garage door;

an interior tension member having an interior bend spaced from the exterior bend and adapted to allow the interior tension member to mate with and to apply tension to the bottom surface of the garage door in an opposite direction of the exterior tension member, thereby adapted to secure the retainer to the bottom surface of the garage door;

a seal cavity between the tension members and the bends adapted to slidably receive and to support the seal; and wherein the exterior tension member includes an exterior gripping edge at an end of the tension member distal to the seal, wherein the gripping edge is adapted to seat upon a shelf of the bottom surface of the garage door.

2. The garage door bottom seal retainer as set forth in claim 1, exterior gripping edge running the entire length of the exterior tension member.

3. A garage door bottom seal retainer for securing a seal to a bottom surface of a garage door, the retainer comprising:

an exterior tension member having an exterior bend adapted to allow the exterior tension member to mate with and to apply tension to the bottom surface of the garage door;

an interior tension member having an interior bend spaced from the exterior bend and adapted to allow the interior tension member to mate with and to apply tension to the bottom surface of the garage door in an opposite direction of the exterior tension member, thereby adapted to secure the retainer to the bottom surface of the garage door;

a seal cavity between the tension members and the bends adapted to slidably receive and to support the seal; and wherein the interior tension member includes an interior gripping edge at an end of the tension member distal to the seal, wherein the gripping edge is adapted to seat upon a shelf of the bottom surface of the garage door.

4. The garage door bottom seal retainer as set forth in claim 3, the interior gripping edge running the entire length of the interior tension member.

5. A garage door bottom seal retainer for securing a seal to a bottom surface of a garage door, the retainer comprising:

an exterior tension member running substantially the entire length of the retainer and having an exterior bend adapted to allow the exterior tension member to mate with and to apply tension to the bottom surface of the garage door;

an exterior gripping edge at an end of the exterior tension member distal to the seal, wherein the exterior gripping edge is adapted to seat upon an exterior shelf of the bottom surface of the garage door;

an interior tension member running substantially the entire length of the retainer and having an interior bend spaced from the exterior bend and adapted to allow the interior tension member to mate with and to apply tension to the bottom surface of the garage door in an opposite direction of the exterior tension member, thereby adapted to secure the retainer to the bottom surface of the garage door;

an interior gripping edge at an end of the interior tension member distal to the seal, wherein the interior gripping edge is adapted to seat upon an interior shelf of the bottom surface of the garage door; and a seal cavity between the tension members and the bends adapted to slidably receive and to support a seal.

6. The garage door bottom seal retainer as set forth in claim 5, the retainer being between five and twenty feet long.

7. The garage door bottom seal retainer as set forth in claim 5, exterior gripping edge running the entire length of the exterior tension member.

8. The garage door bottom seal retainer as set forth in claim 5, the interior gripping edge running the entire length of the interior tension member.

9. The garage door bottom seal retainer as set forth in claim 5, seal cavity being offset toward the exterior tension member.

10. The garage door bottom seal retainer as set forth in claim 5, the retainer constructed of a material selected from the group consisting of steel, plastic, aluminum, tin, copper, brass, and stainless steel.

11. A garage door bottom seal retainer approximately eight feet long for securing a seal to a bottom surface of a garage door, the retainer comprising:

an exterior tension member having an exterior bend adapted to allow the exterior tension member to mate with and to apply tension to the bottom surface of the garage door, wherein the tension member extends approximately one-half inch beyond the bend;

an exterior gripping edge running the entire length of the exterior tension member extending approximately one-fourth inch beyond an end of the tension member distal to the seal, wherein the exterior gripping edge is adapted to seat upon an exterior shelf of the bottom surface of the garage door;

an interior tension member having an interior bend spaced from the exterior bend, wherein the interior tension member extends approximately one-half inch beyond the interior bend and the interior bend is adapted to allow the interior tension member to mate with and to apply tension to the bottom surface of the garage door in an opposite direction of the exterior tension member, thereby adapted to secure the retainer to the bottom surface of the garage door;

an interior gripping edge running the entire length of the interior tension member-extending approximately one-fourth inch beyond an end of the tension member distal to the seal, wherein the interior gripping edge is adapted to seat upon an interior shelf of the bottom surface of the garage door; and a seal cavity approximately one-fourth inch high and one-fourth inch wide, the cavity located between the tension members and the bends and offset toward the exterior tension member, wherein the cavity is adapted to slidably recieve and to support a seal.

12. The garage door bottom seal retainer as set forth in claim 11, the retainer being between five and twenty feet long.

13. The garage door bottom seal retainer as set forth in claim 11, the retainer constructed of a material selected from the group consisting of steel, plastic, aluminum, tin, copper, brass, and stainless steel.

14. A garage door comprising:

a plurality of articulating panels, one of the panels having a bottom surface including an exterior lip extending downwardly from the bottom surface and an interior lip extending downwardly from the bottom surface;

a seal retainer attached to the bottom surface the retainer comprising, an exterior tension member having an exterior bend adapted to allow the exterior tension member to mate with and to apply tension to the exterior lip of the bottom surface, an interior tension member having an interior bend spaced from the exterior bend and adapted to allow the interior tension member to mate with and to apply tension to the interior lip of the bottom surface in an opposite direction of the exterior tension member, thereby securing the retainer to the bottom surface of the garage door, and a seal cavity between the tension members and the bends;

a seal attached to the retainer, the seal comprising, a cylindrical cushion for sealing the door to a floor, and a retaining member adapted to be slid down the seal cavity, thereby mating the seal to the retainer; and wherein the exterior tension member includes an exterior gripping edge at an end of the tension member distal to the seal, wherein the gripping edge is adapted to seat upon a shelf of the exterior lip.

15. A garage door comprising:

a plurality of articulating panels, one of the panels having a bottom surface including exterior lip extending downwardly from the bottom surface, and an interior lip extending downwardly from the bottom surface;

a seal retainer attached to the bottom surface, the retainer comprising, an exterior tension member having an exterior bend adapted to allow the exterior tension member to mate with and to apply tension to the exterior lip of the bottom surface, an interior tension member having an interior bend spaced from the exterior bend and adapted to allow the interior tension member to mate with and to apply tension to the interior lip of the bottom surface in an opposite direction of the exterior tension member, thereby securing the retainer to the bottom surface of the garage door, and a seal cavity between the tension members and the bends:

a seal attached to the retainer, the seal comprising, a cylindrical cushion for sealing the door to a floor, and a retaining member adapted to be slid down the seal cavity, thereby mating the seal to the retainer; and wherein the interior tension member includes an interior gripping edge at an end of the tension member distal to the seal, wherein the gripping edge is adapted to seat upon a shelf of the interior lip.

* * * * *